United States Patent [19]

von Recklinghausen

[11] 4,406,921

[45] Sep. 27, 1983

[54] APPARATUS FOR IMPROVING LINEARITY OF ELECTROMECHANICAL TRANSDUCERS

[75] Inventor: Daniel R. von Recklinghausen, Arlington, Mass.

[73] Assignee: Electro Audio Dynamics, Inc., Great Neck, N.Y.

[21] Appl. No.: 273,742

[22] Filed: Jun. 15, 1981

[51] Int. Cl.[3] ..... H04R 29/00

[52] U.S. Cl. ..... 179/1 N; 179/1 F; 179/175.1 A

[58] Field of Search ..... 179/1 N, 1 F, 1 D, 175.1 A; 307/252 W; 73/589

[56] References Cited

U.S. PATENT DOCUMENTS 3,686,511 8/1972 Pauly ..... 307/252 W X

OTHER PUBLICATIONS

Tremaine, H. M., *Audiocyclopedia,* 1979, pp. 1115–1116.

*Primary Examiner*—Gene Z. Rubinson
*Assistant Examiner*—James L. Dwyer
*Attorney, Agent, or Firm*—Holland, Armstrong, Wilkie & Previto

[57] ABSTRACT

An improved circuit for a transducer or loud-speaker as used in the measurement of acoustic quantities such as in impedance audiometers for providing accurate linear read outs.

7 Claims, 5 Drawing Figures

Fig. 1.
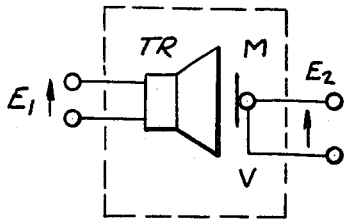
Fig. 2.
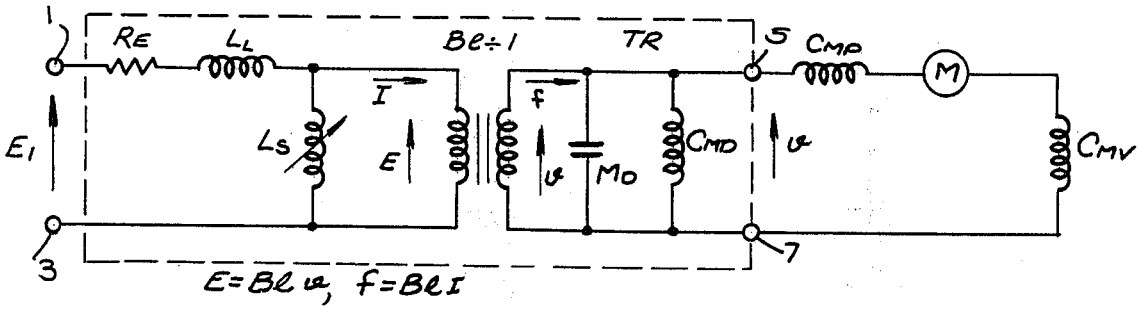
Fig. 3.
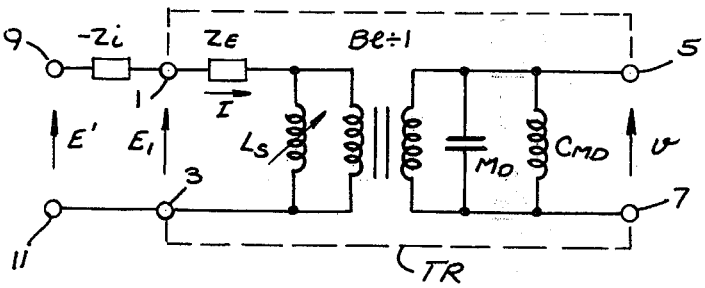
Fig. 5.
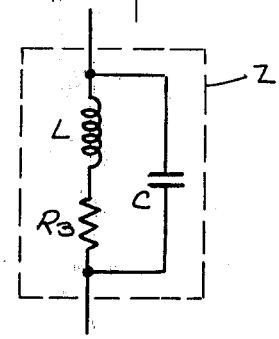
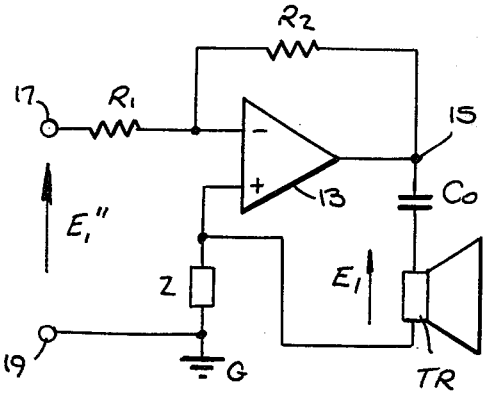
Fig. 4.
TABLE I
$$\frac{E_1''}{E_1} = -\frac{R_1}{R_2}\left(1 - \frac{1 + R_2/R_1}{1 + Z_L/Z}\right)$$
WHERE $Z_L = E_1/I_1$
$$Z_i = -\frac{R_2}{R_1} Z$$

APPARATUS FOR IMPROVING LINEARITY OF ELECTROMECHANICAL TRANSDUCERS

BACKGROUND OF THE INVENTION

The present invention relates to improvements in apparatus primarily designed to measure the acoustic impedance or admittance of structures more particularly, it relates to apparatus designed to make such measurements for the human external auditory canal.

In prior art, the measurement of the acoustic impedance or the measurement of the reciprocal acoustic admittance has typically involved the measurement of such quantities at relatively low frequencies where each acoustic element was believed to be relatively small compared to the wavelength of sound and it could thus be treated as a lump constant, such as mass or stiffness. This is similar to describing electrical structures which are measured as having the value of capacitance or inductance rather than being parts of distributed circuits or transmission lines. In the present invention, the type of transducers typically employed in the prior art are electromagnetic transducers of the moving iron type because these are relatively efficient and can be produced with relatively small dimensions for the purpose. The major disadvantages of such devices has been their nonlinearity because they were often employed not only for the purpose of transmitting measuring signals the voltage of which was measured across the terminals of the transducer, but also simultaneously to produce additional acoustic signals in the ear to measure the reaction of the human muscular system and nervous sytem when exposed to acoustic stimuli.

This problem has caused severe measurement interaction because of the non-linearity of these transducers. A further problem has been that the characteristics were extremely variable from unit to unit so that non-linear compensating circuits could not be employed.

In the present invention, these disadvantages have been overcome by a rather simple circuit based on an electromechanical analysis of the transducer and probe circuits themselves.

A preferred embodiment of the invention has been chosen for purposes of illustration and description and is shown in the accompanying drawings, forming a part of the specification wherein:

FIG. 1 is a schematic and block diagram of a typical measurement probe.

FIG. 2 is a schematic representation of the electroacoustic circuitry involved with the proper transforming equations.

FIG. 3 is a modification of FIG. 2 with a compensating circuit attached.

FIG. 4 illustrates one embodiment of an implementation of the compensating circuit.

FIG. 5 is a modification of the element Z of FIG. 4.

DESCRIPTION OF THE PREFERRED EMBODIMENTS

In FIG. 1 a transmitter TR shown schematically as a loud speaker and a microphone M are enclosed in a common volume V with the input voltage $E_1$ to the transducer TR and the output voltage $E_2$ of the microphone. The purpose is to measure these signals so that a measurement of this volume V can eventually be performed as explained in my co-pending application Ser. No. 275,866, entitled Apparatus for Measurement of Acoustic Impedance, filed June 22, 1981.

In FIG. 2, the detailed constituent parts of FIG. 1 are shown. The transducer TR, having electrical input terminals 1 and 3 with input voltage $E_1$, is shown as its equivalent circuit consisting of the electrical winding resistance Re, leakage inductance of the winding $L_L$, a shunt inductance $L_s$ connected across the terminals of an ideal transformer T schematically represented as having turns ratio B1:1. The secondary of transformer T drives the mechanical equivalent of the mass of the diaphragm $M_d$ and the compliance of the diaphragm $C_{md}$ the output of which provides an equivalent velocity v at terminals 5 and 7 to which in turn is connected as a load, the compliance of the probe itself $C_{mp}$, the microphone M, and the compliance $CM_v$ of the volume V to be measured. The ideal transformer T with turns ration B1:1 operates on the following equations, namely, electrical voltage E across its primary terminals is equal to BL×v and F (force)=BL×(current) I.

The moving iron tongue normally driving the diaphragm is subject to magnetic saturation and as such causes a variable shunt inductance $L_s$ to occur. Therefore, element $L_s$ causes severe measurement difficulties not only in terms of linearity at a single frequency, but also in terms of intermodulation products which can occur when multiple frequencies are imposed at terminals 1 and 3. For example, during the measurement of human reaction to acoustic stimuli, two frequencies are presented simultaneously to the human ear. The frequency of 226 Hz is typically used as a fixed probe frequency to measure ear volume, whereas the stimulus frequency of substantially greater intensity than the measuring frequency is typically presented at 500 Hz, 1 KHz, or higher frequencies to excite a nervous reflex in the person tested, resulting in a small volume change. This higher high frequency signal causes the saturation of an inductor $L_s$ to change and therefore, the shunt element across the primary transformer T to vary in value. This intermodulation in turn causes the measurement to become seriously in error and to be meaningless. Consequently, in prior art, not only one transducer TR in the same volume V, but a second transducer carefully isolated have been used to provide the so-called stimulus signals.

It has been found, however, that the difficulties associated with the inductor $L_s$ could be compensated for by an appropriate negative impedance as shown in FIG. 3. Here, the combination of series resistance and leakage inductance $R_e$ and $L_L$ have been lumped together into an impedance $Z_e$ connected across terminals 1 and 3 of transducer TR and, consequently, a negative impedance connected in series with these terminals would then provide a voltage identical to the voltage across the transformer directly at the input. The variable shunt effects of inductor $L_s$ demonstrate themselves only as additional current requirements and not as a voltage or change in acoustic performance. Consequently, the input voltage E' impresssed across terminals 9 and 11 then becomes an accurate representation of linear velocity at terminals 5 and 7. As an added, unexpected benefit, the possible nonlinear diaphragm suspension compliance $C_{md}$ causes no adverse acoustic effects.

The implementation of such a negative impedance $-Z_e$ is accomplished by the circuit of FIG. 4 consisting of an operational amplifier 13 having input terminals − and + and output terminals 15. The input signal $E_1'$ is impressed via resistor $R_1$ to the − input of operational amplifier 13 and the output voltage from terminal 15 is fed back via resistor $R_2$ to the − input of operational amplifier 13. The output voltage is provided via a very large capacitor $C_o$ to transducer TR connected to the + input of operational amplifier 13. The output current of transducer TR flows via constant impedance Z to ground G thereby providing positive current feedback. Capacitor $C_o$ prevents dc instability. It can be seen, if for example, this constant impedance Z were provided, the amplification and the internal impedance would be as those shown in Table 1. Consequently, it can be appreciated that the measurement of acoustic impedance is made possible by an appropriate negative impedance which compensates for the electrical leakage impedances of the transducer TR itself. In the preferred embodiment shown, input voltage $E_1''$ at terminals 17 and 19 is now proportional to velocity v at terminals 3 and 5.

In FIG. 5, a preferred embodiment of the feedback element Z is shown in which resistor $R_3$ and inductor L provide for the negative impedance proportional in value to resistors $R_e$ and leakage inductor $L_L$. As a matter of fact, these could be exactly equal to those if resistors $R_1$ and $R_2$ were chosen to be identical. Capacitor C connected in parallel with resistor $R_3$ provides for high frequency stability of operational amplifier 13 which typically has a finite gain at very high frequencies above the audio frequency range.

If the relatively small leakage inductance of transducer TR is deemed to be of relatively small importance, inductor L can be neglected and replaced by a short circuit.

Customarily in prior art, transducers for the measurement of acoustic quantities such as in impedance audiometers, have involved the use of a series resistance which was adjusted in value to calibrate the instrument and difficulties had consistently been observed in maintaining calibration and in maintaining linearity of operation. The present simple circuit has improved matters and also permits the manufacture of probes of very small dimensions requiring only one transducer TR instead of two transducers to provide both stimulus and measuring signals which are provided and measured at the inputs 17 and 19 of the negative impedance circuit.

As various changes may be made in the form, construction and arrangement of the parts herein without sacrificing any of its advantages, it is to be understood that all matter herein is to be interpreted as illustrative and not in a limiting sense.

Having thus described my invention, I claim:

1. In a circuit including a transducer for producing acoustic signals in an acoustic impedance under test the improvement comprising a compensating circuit including a negative impedance coupled in the input of the transducer, said negative impedance comprising an operational amplifier having the input signal applied to a negative input and the amplifier output signal fed back to the same input and with the amplifier output coupled through a capacitor to the transducer and the positive operational amplifier input.

2. The improvement as claimed in claim 1 in which the transducer output current flows to ground through a preset impedance.

3. The improvement as claimed in claim 2 in which said present impedance comprises a capacitor connected in parallel with a series connection of an inductance and a resistor.

4. The improvement as claimed in claim 3 in which said resistor and inductance provide said negative impedance proportional to the transducer leakage resistance and the leakage inductance of the transducer winding.

5. The improvement as claimed in claim 2 in which said constant impedance comprises a resistor and capacitor connected in paralle.

6. The improvement as claimed in claim 2 in which said preset impedance has temperature coefficients similar to the temperature coefficients of said transducer.

7. The improvement as claimed in claim 2 and in which said input signal and said amplifier output signal are fed back to the negative input via a first resistor and a second resistor respectively.

* * * * *